US006598525B2

(12) United States Patent
Metrope

(10) Patent No.: US 6,598,525 B2
(45) Date of Patent: Jul. 29, 2003

(54) DEVICE FOR SEALING OFF AN INK SUPPLY ON PRINTING MACHINES

(75) Inventor: Jacques Metrope, Laigneville (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 225 days.

(21) Appl. No.: 09/725,342

(22) Filed: Nov. 29, 2000

(65) Prior Publication Data

US 2002/0134263 A1 Sep. 26, 2002

(30) Foreign Application Priority Data

Nov. 29, 1999 (DE) ..... 199 57 464
Jul. 28, 2000 (FR) ..... 00 09931

(51) Int. Cl.[7] ..... B41F 1/46
(52) U.S. Cl. ..... 101/363; 101/365
(58) Field of Search ..... 101/363, 364, 101/365, 366, 367, 344, 347, 360, 350.1

(56) References Cited

U.S. PATENT DOCUMENTS 3,135,197 A * 6/1964 Dutro et al. ..... 101/364
3,561,360 A * 2/1971 Branfield et al. ..... 101/365
3,788,220 A * 1/1974 Laben et al. ..... 101/363
3,831,517 A * 8/1974 Wagner ..... 101/363
4,155,303 A * 5/1979 Johnston ..... 101/363
4,419,932 A * 12/1983 Cappel ..... 101/363
4,584,941 A 4/1986 Weber
5,125,341 A * 6/1992 Yaeso ..... 101/363
5,150,651 A * 9/1992 Flores ..... 101/366
5,182,989 A * 2/1993 D'Heureuse et al. ..... 101/363
5,481,974 A * 1/1996 Sarazen et al. ..... 101/363
5,662,042 A * 9/1997 Compton et al. ..... 101/363
5,809,887 A 9/1998 Blackwell et al.
5,927,199 A * 7/1999 Achelpohl et al. ..... 101/363
5,979,321 A * 11/1999 Koppelkamm et al. ..... 101/363

FOREIGN PATENT DOCUMENTS

| | | |
|---|---|---|
| DE | 1 224 327 | 9/1966 |
| DE | 34 08 183 C1 | 3/1985 |
| DE | 230 483 A3 | 12/1985 |
| DE | 89 12 540.1 U1 | 2/1990 |
| DE | 94 05 883.0 U1 | 7/1994 |
| EP | 0 812 687 A2 | 12/1997 |
| EP | 0 865 917 A2 | 9/1998 |
| FR | 2 734 512 B1 | 11/1996 |
| GB | 2 145 973 A | 4/1985 |

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

A device for receiving an ink supply in an ink feed device in an inking unit of a printing machine, the ink supply being received in a reservoir having elements formed with laterally bounding surfaces, and contact surfaces for sealing off the ink supply with respect to a rotating surface, comprising unipartite side parts, respectively, constituting the elements formed with the bounding surfaces and the contact surfaces, the contact surfaces being engageable with respective contact areas on an ink-fountain roller formed with the rotating surface, the side parts having lip-shaped sealing elements bearing resiliently on the ink-fountain roller.

11 Claims, 3 Drawing Sheets

DEVICE FOR SEALING OFF AN INK SUPPLY ON PRINTING MACHINES

BACKGROUND OF THE INVENTION

Field of the Invention

The invention relates to a device for sealing off an ink supply, such as an ink duct or fountain, on printing machines, whether the latter are web-fed or sheet-fed printing machines.

The published European Patent Document EP 0 812 687 A2 discloses an ink fountain for printing machines and a method of operating a printing machine. The improvement described therein is concerned with sealing off the side surfaces of an ink fountain provided at an ink-fountain roller of an inking unit operating in accordance with the anilox principle, for example. Arranged at the ink fountain is the ink-fountain roller, against which an inking chamber is set, which is bounded or defined by two doctor blades. The two doctor blades are a metering doctor blade and a doctor blade that removes contaminants, both being accommodated on the end surfaces bounding the inking chamber. The end surfaces which bound the inking chamber and accommodate the metering doctor blade and the doctor blade that removes the contaminants are all supported on the ink-fountain roller. In the construction disclosed in the aforementioned European Patent Document EP 0 812 687 A2, a first pressure is exerted upon the ink-fountain roller by the end surface, and a second, higher pressure is exerted upon the metering doctor blade and the doctor blade that removes the contaminants. In addition, recesses are provided in the end surfaces and are closed by a circumferential closed bridge or stud, in order to produce a great local stiffness at the doctor clamping locations than at the roller surface.

The published German Patent Document DE 34 08 183 C1 discloses an ink fountain for printing machines, having a lower part forming an ink knife. This ink knife can be adjusted with respect to the ink-fountain roller, the ink supply being located between the lower part and the ink-fountain roller, and being bounded at both ends by ink-fountain jaws which seal off the ink fountain with respect to the circumferential or jacket surface of the ink-fountain roller by a sealing surface. The ink that emerges as a result of leakage losses is fed back to the ink supply again, whereby contamination of the inking unit is avoided. For this purpose, on the ink-fountain jaws, more specifically on the respective sealing surfaces thereof facing towards the ink-fountain roller, a contact surface is formed, which covers part of the width of the ink-fountain jaw and extends obliquely with respect to the latter, so that the lower end of the contact surface is directed towards the inner side of the ink fountain. In addition to the formation of a contact surface that extends obliquely to the ink-fountain jaw, this contact surface can also be formed to extend spirally.

The sealing action of the contact surface disclosed in t5he aforementioned German Patent Document DE 34 08 183 C1 depends mainly upon the manufacturing precision of the ink-fountain jaws, and also upon the positioning accuracy thereof relative to the ink-fountain roller. A deviation in the curvature of the ink-fountain jaw and the ink-fountain roller remains, because of manufacturing tolerances which inevitably occur. The resilient elastomeric material used for the ink-fountain jaws is subject to moisture and temperature fluctuations, to which the printing machine is subjected relative to a wide range of production conditions. The dimensional stability of a synthetic material is not ensured under these environmental influences. Consequently, in spite of an initially functioning sealing action, leaks at the ink fountain can occur over the course of operation of the printing machine.

French Patent 2 734 51.2 has disclosed a further ink fountain for a printing machine, wherein the ink-fountain jaws are likewise set against the ink-fountain roller surface by an adjusting device in order to achieve a sealing action. By using the aforementioned adjusting device, determined inaccuracies which result during the manufacture of the ink-fountain jaws are intended to be compensated for. The contact surface of the ink-fountain jaws on the ink-fountain roller should extend cylindrically in order to ensure continuous contact around the surface of the ink-fountain roller. With the construction disclosed by French Patent 2 734 512, the cylindricity of the contact surfaces cannot be maintained, because, with this construction, only part of the surface curvature of the contact surface of the ink-fountain jaw is deformed. It is therefore not possible for an optimum sealing action to be achieved by using the construction disclosed in French Patent 2 734 512.

SUMMARY OF THE INVENTION

Starting from the outlined state of the prior art, it is an object of the invention to provide a device for sealing off an ink supply in printing machines, which effectively ensures the sealing off of an ink-accepting reservoir during all operating phases of a printing machine.

With the foregoing and other objects in view, there is provided, in accordance with one aspect of the invention, a device for receiving an ink supply in an ink feed device in an inking unit of a printing machine, the ink supply being received in a reservoir having elements formed with laterally bounding surfaces, and contact surfaces for sealing off the ink supply with respect to a rotating surface, comprising unipartite side parts, respectively, constituting the elements formed with the bounding surfaces and the contact surfaces, the contact surfaces being engageable with respective contact areas on an ink-fountain roller formed with the rotating surface, said side parts having lip-shaped sealing elements bearing resiliently on the ink-fountain roller.

In accordance with another feature of the invention, the sealing elements are formed with free spaces extending therebehind.

In accordance with a further feature of the invention, the free spaces, respectively, follow a course corresponding to the course of a curvature of the respective sealing elements.

In accordance with an added feature of the invention, the sealing elements, respectively, are formed with a contact surface by which they are seated on an ink knife.

In accordance with an additional feature of the invention, the sealing elements, respectively, have cross-sectional courses tapering towards the contact surfaces, respectively.

In accordance with yet another feature of the invention, the sealing elements of the side parts are formed with rounded contours.

In accordance with yet a further feature of the invention, the sealing elements are resilient.

In accordance with yet an added feature of the invention, one of the side parts functions as a dividing element between two ink supplies.

In accordance with yet an additional feature of the invention, the one side part has a sealing element with a double lip formed with continuously tapering areas extending from a web, and having a decreasing cross-sectional course.

In accordance with another aspect of the invention, there is provided an ink fountain in an inking unit of a printing machine, for receiving an ink supply in a reservoir having elements formed with laterally bounding surfaces, and contact surfaces for sealing off the ink supply with respect to a rotating surface, comprising unipartite side parts, respectively, constituting the elements formed with the bounding surfaces and the contact surfaces, the contact surfaces being engageable with respective contact areas on an ink-fountain roller formed with the rotating surface, the side parts having lip-shaped sealing elements bearing resiliently on the ink-fountain roller.

In accordance with a further aspect of the invention, there is provided an inking unit of a printing machine having a device for receiving an ink supply, the device being formed with laterally bounding surfaces, and contact surfaces for sealing off the ink supply with respect to a rotating surface, comprising unipartite side parts formed with the bounding surfaces, and the contact surfaces, the contact surfaces being engageable with respective contact areas on an ink-fountain roller formed with the rotating surface, the side parts having lip-shaped sealing elements bearing resiliently on the ink-fountain roller.

In accordance with a concomitant aspect of the invention, there is provided a printing unit of a printing machine, having a device for receiving an ink supply, the device being formed with laterally bounding surfaces, and contact surfaces for sealing off the ink supply with respect to a rotating surface, comprising unipartite side parts formed with the bounding surfaces, and the contact surfaces, the contact surfaces being engageable with respective contact areas on an ink-fountain roller formed with the rotating surface, the side parts having lip-shaped sealing elements bearing resiliently on the ink-fountain roller.

The advantages which are achievable with the construction according to the invention are that, when mounting the side parts on the ink fountain of the inking unit, neither special expertise is now necessary, nor are side parts of particularly complicated construction required in the ink fountain of a rotary printing machine. The monobloc or unipartite side parts may be produced simply, for example, of plastic material, it being, in particular, possible for the shaping of the free spaces behind the lip-like sealing elements to be particularly straightforward. The plastic side parts are further distinguished by a resilience which differs depending upon the material selected. Thereby, it is possible to realize contact pressures of the sealing elements upon the rotating ink-fountain roller surface which are adapted to pasty inks of different viscosities, and to decorative inks which are used in the offset process.

In a further refinement of the idea upon which the invention is based, the free spaces which extend behind the sealing elements are located immediately behind the sealing elements, so that the resilience of the latter is advantageously influenced. In order to achieve uniform resilience of the sealing element, the free space extends with an identical course of curvature, compared with the course of the curvature realized on the sealing element.

In order to achieve an optimum sealing off on ink fountains of a rotary printing machine, the lip-shaped sealing elements in the contact area on the ink knife are provided with a contact surface in order to achieve optimum sealing off even in the wedge region between the ink-fountain roller surface and the upper side of the ink knife.

The resilience of the sealing lip set against the surface of the ink-fountain roller is assisted or reinforced by the possibility of the lip to be formed with a cross section which tapers continuously and extends towards the contact line with the surface of the ink fountain roller. The cross section of the sealing elements can also have a discontinuous course in the direction of the contact line on the ink-fountain roller, so that sealing shapes which can be used individually can be produced in a straightforward manner.

On the outside of the sealing elements, an inwardly directed, rounded contour can be provided, with which easy monitoring of the correct seating of the side parts can be performed. The resilience of the sealing elements bearing against the surface of the ink-fountain roller can be assisted or reinforced by the material selection for the side parts, the course of the curvatures of the free spaces, or else a spring-assisted setting of the free ends of the sealing elements on the rotating surface.

In an advantageous improvement in a side part, the latter can be equipped with a double-lip sealing element, which can function as a dividing element in the ink fountain in order to separate different ink supplies from one another, for example, for applications in newspaper printing. The double lip extends with two extensions thereof on either side of a web and, in this way, divides or separates two ink supplies from one another by means the dovetail configuration thereof. On the double lip, too, both sealing surfaces can be formed with cross-sectional surfaces which taper continuously towards the contact surface on the ink-fountain roller surface.

The one-piece side parts with sealing surfaces formed thereon may be used on ink fountains of sheet-processing or web-processing rotary machines, and in addition on varnishing units of rotary printing machines, in order to process decorative inks, for commercial or jobbing web-fed rotary printing machines in rotary newspaper printing, wherein a division or separation of the ink supplies by using a dividing or separating element is able to be effected very easily.

Other features which are considered as characteristic for the invention are set forth in the appended claims.

Although the invention is illustrated and described herein as embodied in a device for sealing off an ink supply in printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
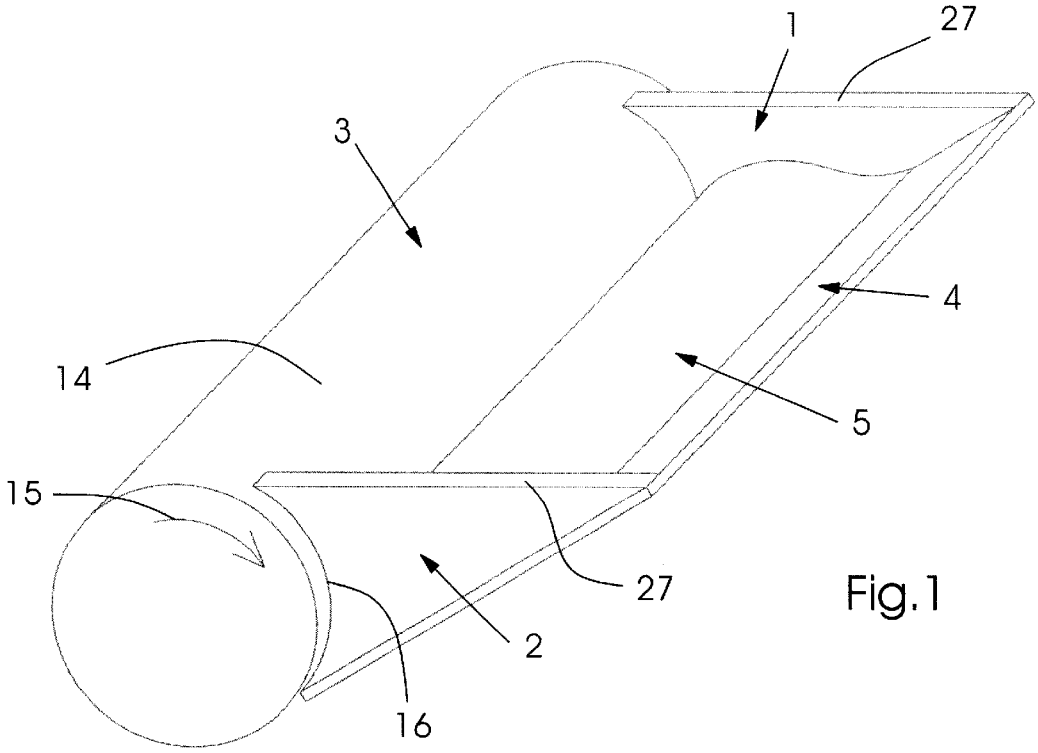
FIG. 1 is a side, top and rear perspective view of an ink fountain or duct.

Referring now to the drawings and, first, particularly to FIG. 1 thereof, there is shown therein an ink fountain or duct in a perspective view.

An ink feed device commonly used in rotary printing machines includes an ink-fountain roller 3, an ink knife 4, which functions as the bottom part of the ink fountain, and side parts 1 and 2 which are assembled laterally relative to the ink-fountain roller 3. An ink supply 5 is accepted and retained within these four components of an ink feed device of a printing machine, and is fed in a metered manner to an inking unit generally including a number of rollers effecting ink-film splitting. Through the intermediary of the ink-fountain roller 3, which moves in the direction of rotation 15, and the ink knife 4 set against the surface 14 thereof, the metering of the ink supply 5 is performed by setting the ink knife 4, which forms the bottom of the ink fountain and which can be subdivided zonally or zone-by-zone into individual ink-knife tongues, or can even be set as a whole, onto or away from the surface 14 of the ink-fountain roller 3.

The side parts 1 and 2 which seal off the ink supply 5 against undesired lateral emergence from the ink feed devices have contact surfaces 16, the respective contour of which is matched to the curvature of the surface 14 of the ink-fountain roller 3, in order thereby to bring about the tightest possible contact between the respective side parts 1 and 2 and the surface 14 of the ink-fountain roller 3. The side parts 1 and 2 of the ink feed device have an upper, horizontally extending edge 27 which limits the maximum fill level in the ink fountain.

Figure 2:
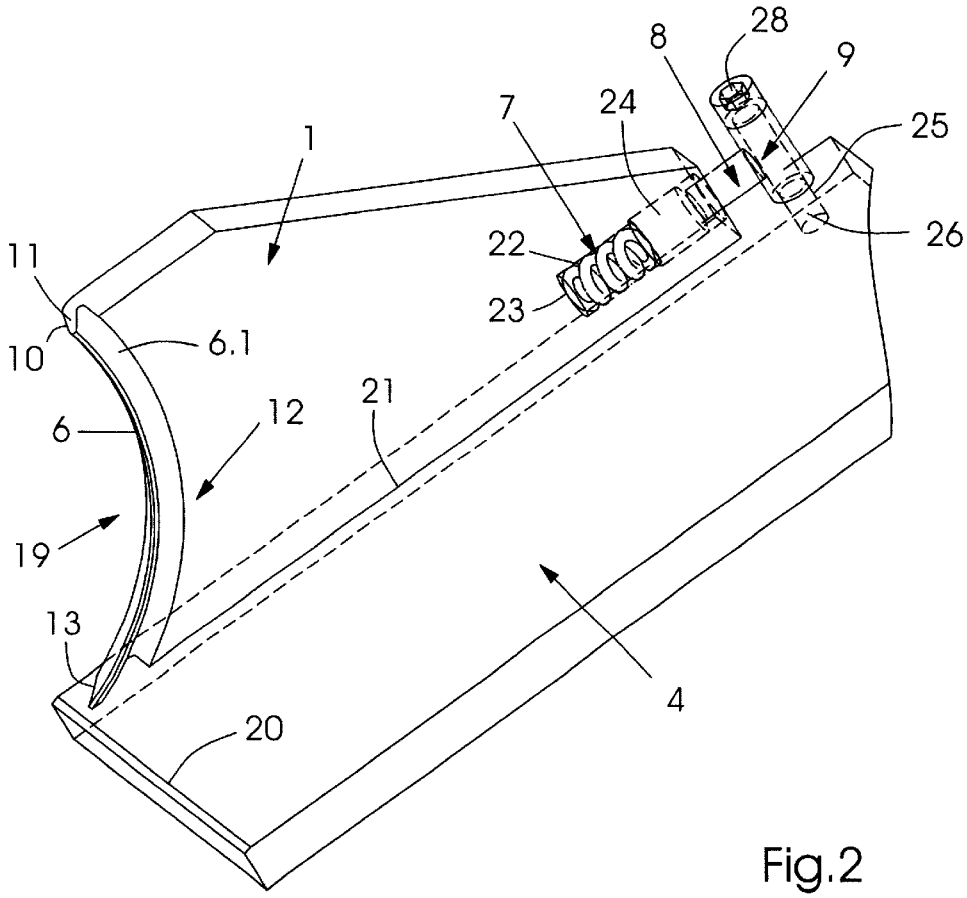
FIG. 2 is a top, side and front perspective view of one of the side parts of an ink fountain according to the invention having a lip-shaped sealing element on a cylindrical surface thereof which makes contact with an ink-fountain roller.

FIG. 2 is a perspective view of a side part according to the invention having a lip-shaped sealing element. The side part 1 is placed with a sealing surface 21 on the ink knife 4 of an ink fountain, the ink knife 4 bearing with an ink-knife edge 20 against the surface 14 of the ink-fountain roller 3, in order to meter the feed of the ink supply 5 onto the rollers of an inking unit, that is not otherwise illustrated in detail herein.

The side part 1 is set onto or against the surface 14 of the ink-fountain roller 3 by a spring element 7, which is enclosed by a drilled hole 22 formed in the side part 1 and, at one end, the spring element 7 is braced against a supporting surface 23 and, at the other end thereof, is supported by a pin on a stop 9. A stop 8 includes a pin 25, which projects into a drilled hole 26 formed in the ink knife 4, and further includes a tool attachment 28. The foregoing also applies analogously to the side part 2 which is not otherwise specifically illustrated in FIG. 2.

In the front region of the side part 1, a lip-shaped sealing element 6 is formed on the latter in one piece. The course of the curvature 19 of the lip-shaped sealing element 6 corresponds with the curvature of the surface 14 of the ink-fountain roller 3. Formed on the underside of the lip-shaped sealing element 6 on the side part 1 is a contact surface 13, which seals off the side part 1 in the wedge region between the ink knife 4 and the ink-fountain roller 3. The lip-shaped sealing element 6 is separated from the wall of the side part 1 by a free space 6.1 which extends with a curvature 12 corresponding to the course 19 of the curvature of the lip-shaped sealing element 6. The lip-shaped sealing element 6 has, in the direction of the contact surface 16 on the ink-fountain surface 14, a continuously tapering cross section, with which the resilience of the sealing element 6 is adjustable. The outer side of the side part 1 is provided with a rounded outer contour 10, so that easy monitoring of the sealing gaps from the outside is visually possible. Due to the course 12 of the curvature of the free space 6.1, the resilient properties of the sealing element 6 extend over the curvature 19 thereof, it being also possible for the resilient properties to be influenced by suitable material selection.

Figure 3:
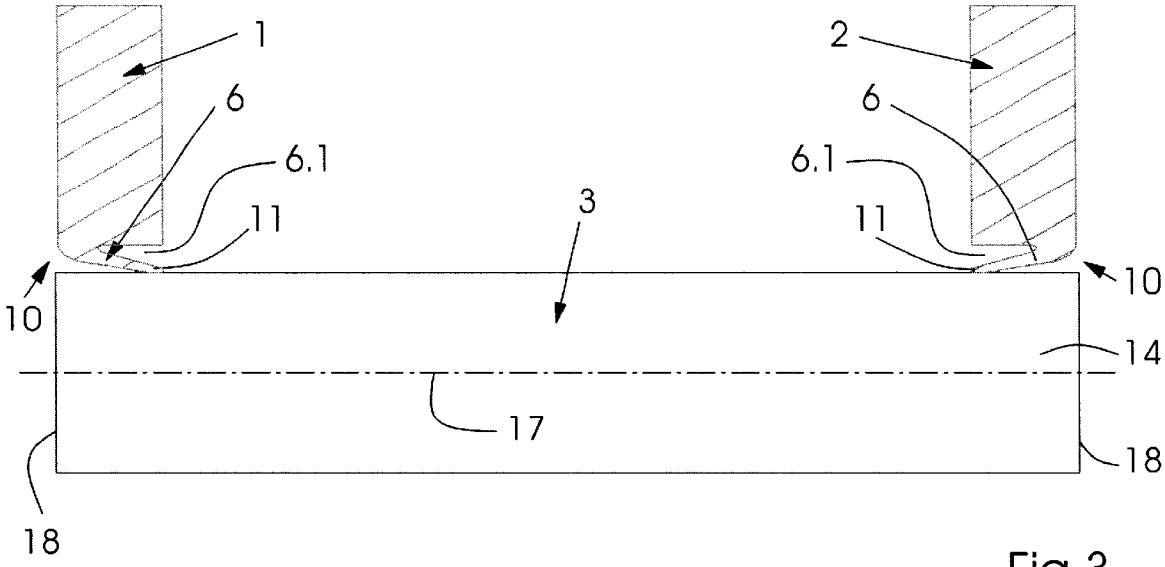
FIG. 3 is a plan view, partly in section, of two side parts of the ink fountain, provided with respective sealing elements engaging with the ink-fountain roller.

FIG. 3 is a greatly simplified plan view, partly in section, of the side parts of an ink fountain, set against an ink-fountain surface 3. The ink-fountain surface 3 corresponds to the circumferential surface 14 of an ink-fountain roller 3 which rotates about an axis 17 thereof and is bounded by two end surfaces 18. The sealing elements 6, respectively, are set resiliently on the surface 14 of the ink-fountain roller 3, which rotates about the axis of rotation 17, the sealing elements 6 being formed on the two side parts 1 and 2 of an ink fountain which bound the ink supply. The sealing elements 6, respectively, extend inwardly in relation to the ink fountain, and are separated from the wall of the respective side parts 1 and 2 by a free space 6.1 which is formed so as to curve in accordance with the curvature of the sealing elements 6. In the region of the respective ends 18 of the ink-fountain roller 3, the sealing elements 6 have a slightly rounded outer contour 10, and a cross section 11 which tapers continuously in the direction of the contact surface thereof with the circumferential surface 14 of the ink-fountain roller 3. The rounded outer contour 10 facilitates easy visual monitoring of the sealing gap, i.e., the contact surface between the lip-shaped sealing elements 6 and the surface 14 of the ink-fountain roller 3.

Figure 4:
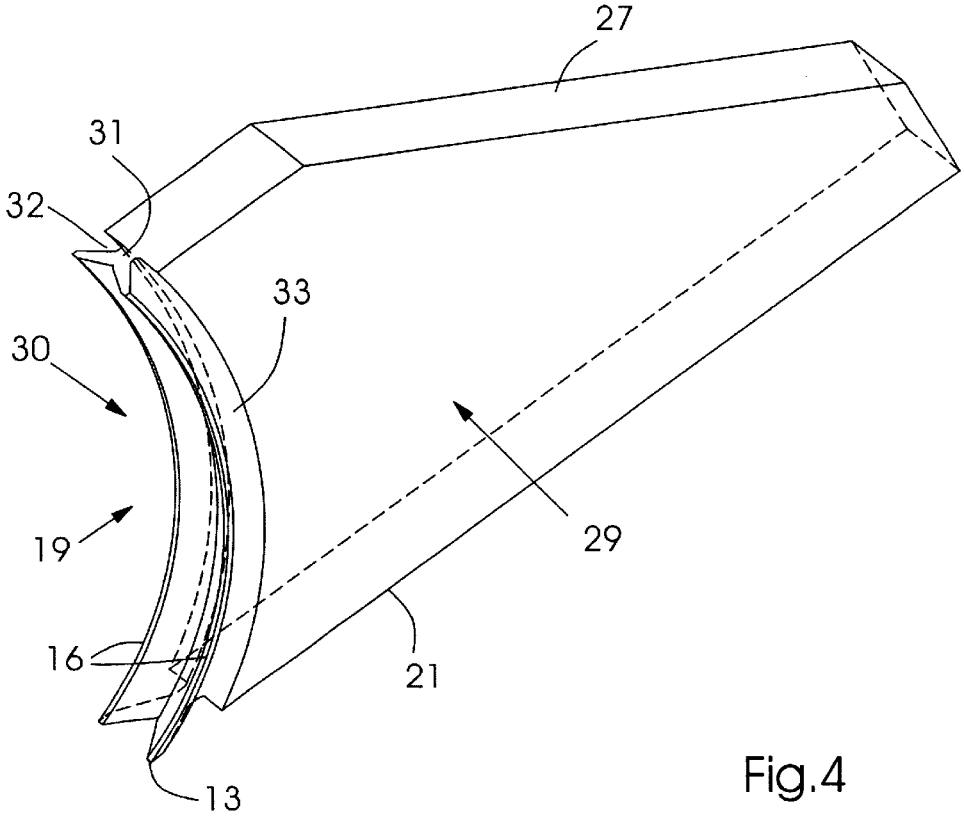
FIG. 4 is a top, side and front perspective view of a dividing or separating element having a double lip.

FIG. 4 is a perspective view of a dividing or separating element with a double-lip sealing element in the ink fountain. The separating element in the form of a side part 29 is provided with an upper edge 27 and with a sealing surface 21, by which the side part 29 is set on the upper side of the ink knife 4 of the ink fountain, and thereby seals off the ink fountain. Arranged in the front region of the side part 29 is a double-lip sealing element 30, which is curved in accordance with the course 19 of the curvature, in order to effect a sealing action on the circumferential surface 14 (not illustrated here) of an ink-fountain roller 3. Formed on both sides of a web 31 are extensions, which likewise can have a cross section which tapers continuously, the extensions being separated from the remainder of the side part 29 by free spaces 32 and 33, respectively, located behind the extensions. Consequently, the extensions, which extend on both sides of the web 31, are provided with a resilience which is further assisted by a continuously tapering cross section of the respective extensions in the direction of the linear contact area thereof with the ink-fountain surface 14. Due to the dovetail geometry of the extensions relative to the web 31, by the contact between the two linearly extending contact areas 16 on the surfaces 14 of an ink-fountain roller 3, a sealing off of the two ink supplies accommodated on either side of the side part 29, which functions as a dividing or separating element, is achieved in one, i.e. a single, ink fountain. Analagous to the side parts 1 and 2, the side part 29 can be formed of plastic material, the resilient properties of the double-lip sealing element 30 being considerably influenced by the material selection. In addition, the width of the web 31 and the depth and the radius of curvature of the free spaces 32 and 33, respectively, formed behind the extensions of the double-lip sealing element have a decisive influence on the resilience which is established in the sealing element 30.

Figure 5:
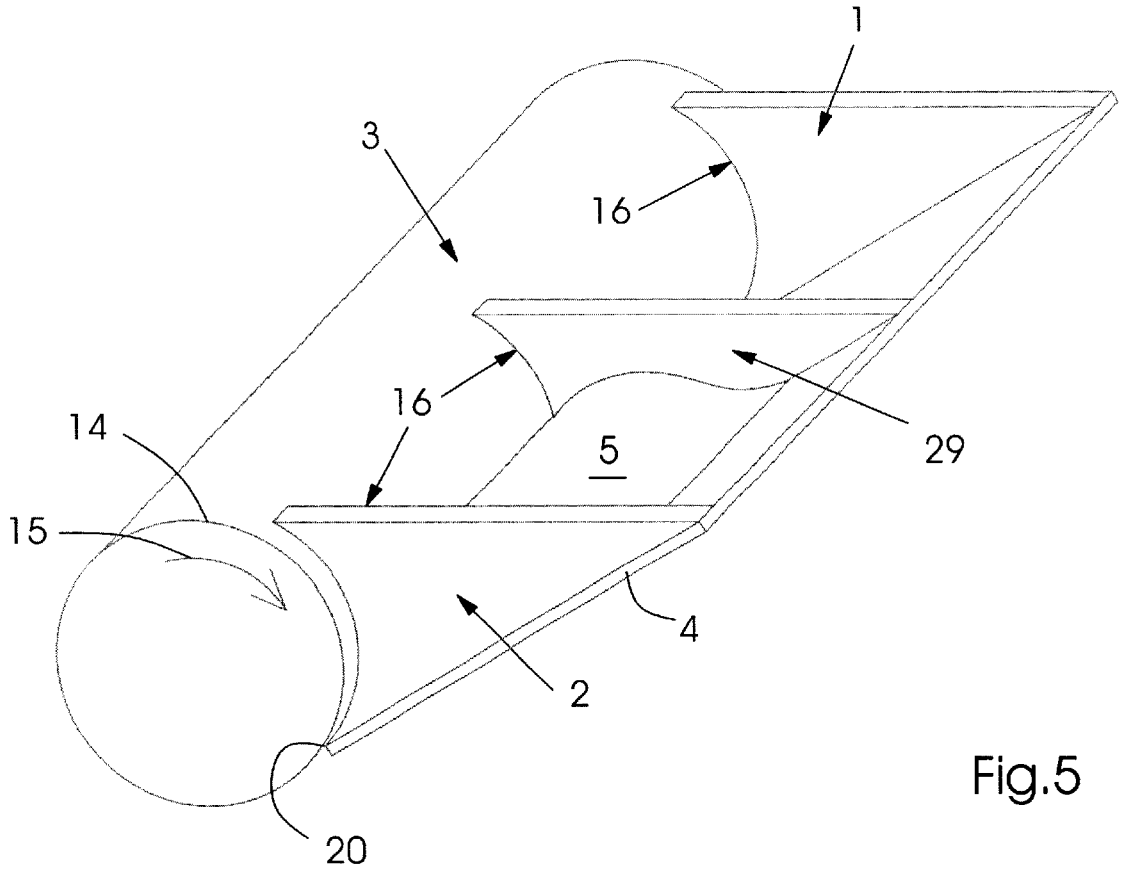
FIG. 5 is a view like that of FIG. 1 showing an ink fountain or duct provided with a dividing or separating element having a double lip, for separating from one another two ink supplies within the ink fountain.

FIG. 5 shows an ink fountain divided by a side part 29, in order to convey a limited ink supply only in a specific inking zone. The embodiment according to FIG. 5 is particularly advantageous for newspaper rotary printing applications, wherein areas are inked with different inks over the width of one inking or printing unit. In the case of newspaper rotary printing machines, for example, the ink zones can be supplied via separate ink supplies. The ink supplies can be accommodated in a unitary ink fountain, as illustrated in FIG. 5, the ink fountain being subdivided over the width thereof, by a central or a plurality of subsurfaces, into various inking chambers, in each of which different ink supplies are accommodated. In this way, it is possible for different inking areas over the width of the ink fountain to be inked with different ink supplies, respectively, whereby subject-dependent inking of the newspaper can be performed due to the subdivision of the ink fountain.

I claim:

1. A device for receiving an ink supply in an ink feed device in an inking unit of a printing machine, the ink supply being received in a reservoir having elements formed with laterally bounding surfaces, and contact surfaces for sealing off the ink supply with respect to a rotating surface, comprising unipartite side parts, respectively, constituting the elements formed with the bounding surfaces and the contact surfaces, the contact surfaces being engageable with respective contact areas on an ink-fountain roller formed with the rotating surface, said side parts having lip-shaped sealing elements bearing resiliently on the ink-fountain roller with cross-sectional courses tapering towards said contact surfaces, respectively.

2. The device according to claim 1, wherein said sealing elements are formed with free spaces extending therebehind.

3. The device according to claim 2, wherein said free spaces, respectively, follow a course corresponding to the course of a curvature of the respective sealing elements.

4. The device according to claim 1, wherein said sealing elements, respectively, are formed with a contact surface by which they are seated on an ink knife.

5. The device according to claim 1, wherein said sealing elements of said side parts are formed with rounded contours.

6. The device according to claim 1, wherein said sealing elements are resilient.

7. The device according to claim 1, wherein one of said side parts functions as a dividing element between two ink supplies.

8. The device according to claim 7, wherein said one side part has a sealing element with a double lip formed with continuously tapering areas extending from a web, and having a decreasing cross-sectional course.

9. An ink fountain in an inking unit of a printing machine, for receiving an ink supply in a reservoir having elements formed with laterally bounding surfaces, and contact surfaces for sealing off the ink supply with respect to a rotating surface, comprising unipartite side parts, respectively, constituting the elements formed with the bounding surfaces and the contact surfaces, the contact surfaces being engageable with respective contact areas on an ink-fountain roller formed with the rotating surface, said side parts having lip-shaped sealing elements bearing resiliently on the ink-fountain roller with cross-sectional courses tapering towards said contact surfaces, respectively.

10. An inking unit of a printing machine having a device for receiving an ink supply, the device being formed with laterally bounding surfaces, and contact surfaces for sealing off the ink supply with respect to a rotating surface, comprising unipartite side parts formed with the bounding surfaces, and the contact surfaces, the contact surfaces being engageable with respective contact areas on an ink-fountain roller formed with the rotating surface, said side parts having lip-shaped sealing elements bearing resiliently on the ink-fountain roller with cross-sectional courses tapering towards said contact surfaces, respectively.

11. A printing unit of a printing machine, having a device for receiving an ink supply, the device being formed with laterally bounding surfaces, and contact surfaces for sealing off the ink supply with respect to a rotating surface, comprising unipartite side parts formed with the bounding surfaces, and the contact surfaces, the contact surfaces being engageable with respective contact areas on an ink-fountain roller formed with the rotating surface, said side parts having lip-shaped sealing elements bearing resiliently on the ink-fountain roller with cross-sectional courses tapering towards said contact surfaces, respectively.

* * * * *